US010682696B2

(12) United States Patent
Fukunaga et al.

(10) Patent No.: US 10,682,696 B2
(45) Date of Patent: Jun. 16, 2020

(54) IMMERSION NOZZLE REPLACEMENT METHOD

(71) Applicant: KROSAKIHARIMA CORPORATION, Fukuoka (JP)

(72) Inventors: Shinichi Fukunaga, Fukuoka (JP); Takahiro Kuroda, Fukuoka (JP); Tatsuya Oouchi, Fukuoka (JP); Takuya Okada, Fukuoka (JP); Akira Ootsuka, Fukuoka (JP)

(73) Assignee: KROSAKIHARMA CORPORATION, Fukuoka (JP)

( * ) Notice: Subject to any disclaimer, the term of this patent is extended or adjusted under 35 U.S.C. 154(b) by 44 days.

(21) Appl. No.: 16/077,587

(22) PCT Filed: Feb. 7, 2017

(86) PCT No.: PCT/JP2017/004416
§ 371 (c)(1),
(2) Date: Aug. 13, 2018

(87) PCT Pub. No.: WO2017/141770
PCT Pub. Date: Aug. 24, 2017

(65) Prior Publication Data

US 2019/0070661 A1 Mar. 7, 2019

(30) Foreign Application Priority Data

Feb. 19, 2016 (JP) ..... 2016-030209

(51) Int. Cl.
*B22D 41/08* (2006.01)
*B22D 41/56* (2006.01)
(Continued)

(52) U.S. Cl.
CPC ..... *B22D 41/56* (2013.01); *B22D 11/10* (2013.01); *B22D 41/502* (2013.01)

(58) Field of Classification Search
CPC ..... B22D 41/56; B22D 11/10
See application file for complete search history.

(56) References Cited

U.S. PATENT DOCUMENTS 5,688,425 A * 11/1997 Yamamoto ..... B22D 41/56 222/606
6,902,121 B2 6/2005 Kawano
(Continued)

FOREIGN PATENT DOCUMENTS

JP 60-15592 B2 4/1985
JP 3009112 U 1/1995
(Continued)

OTHER PUBLICATIONS

International Preliminary Report on Patentability dated Aug. 21, 2018 and Written Opinion for International Application PCT/JP2017/004416 dated Feb. 7, 2017.
(Continued)

*Primary Examiner* — Scott R Kastler
(74) *Attorney, Agent, or Firm* — Paul D. Bianco; Gary S. Winer; Fleit Intellectual Property Law

(57) ABSTRACT

In the method for replacing an immersion nozzle while pushing out a used immersion nozzle by a new immersion nozzle, in order to minimize leakage of molten steel during the replacement, to enable the use of a shaped joint sealer in a joint interface, and to ensure high sealability, a concave portion is formed on the new immersion nozzle's upper plane so as to include a nozzle hole, and the shaped joint sealer is mounted in this concave portion. The immersion nozzle's upper plane is caused to slide while being pressed to the upper nozzle's lower plane.

15 Claims, 11 Drawing Sheets

(51) Int. Cl.
*B22D 11/10* (2006.01)
*B22D 41/50* (2006.01)

(56) References Cited

U.S. PATENT DOCUMENTS

| | | | | |
|---|---|---|---|---|
| 7,108,046 | B2 | 9/2006 | Kawano | |
| 2010/0251533 | A1 | 10/2010 | Yamamoto | |
| 2017/0368597 | A1* | 12/2017 | Yamamoto | B22D 11/10 |
| 2019/0039130 | A1* | 2/2019 | Hattanda | B22D 41/56 |

FOREIGN PATENT DOCUMENTS

| | | | |
|---|---|---|---|
| JP | 7-330448 | A1 | 12/1995 |
| JP | 2977883 | B2 | 9/1999 |
| JP | 2001-286995 | A | 10/2001 |
| JP | 2009-160609 | A | 7/2009 |
| JP | 2009-227538 | A | 10/2009 |
| WO | 02/094476 | A1 | 11/2002 |

OTHER PUBLICATIONS

International Search Report dated Apr. 5, 2017 for International Application PCT/JP2017/004416 filed Feb. 7, 2017.
Written Opinion for International Application PCT/JP2017/004416 dated Feb. 7, 2017.

* cited by examiner

FIG. 7a
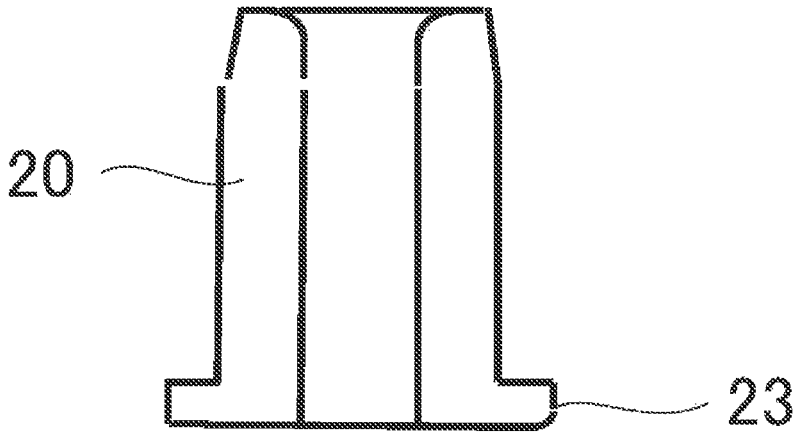
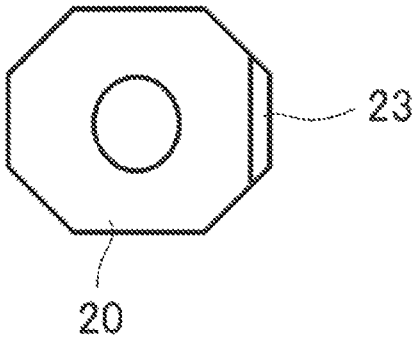
FIG. 7b

FIG. 8a
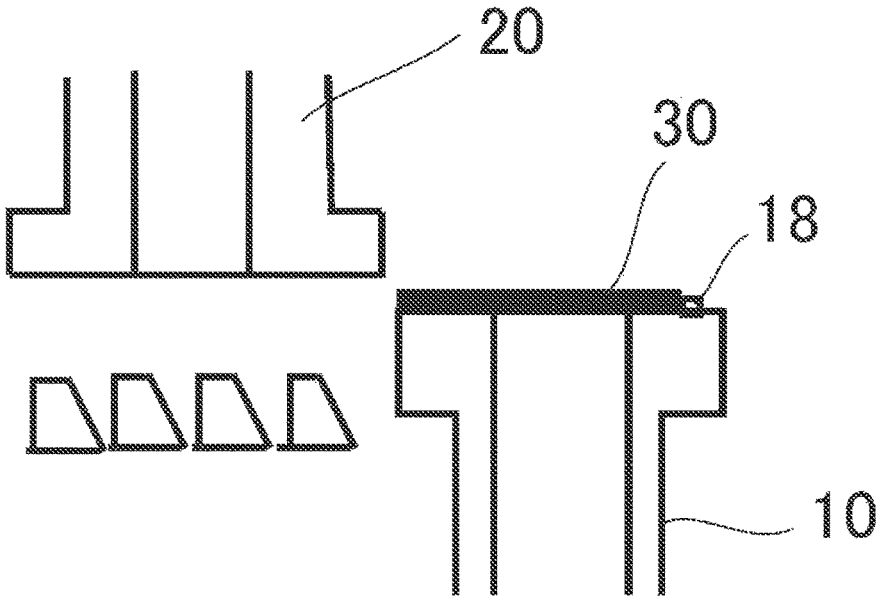
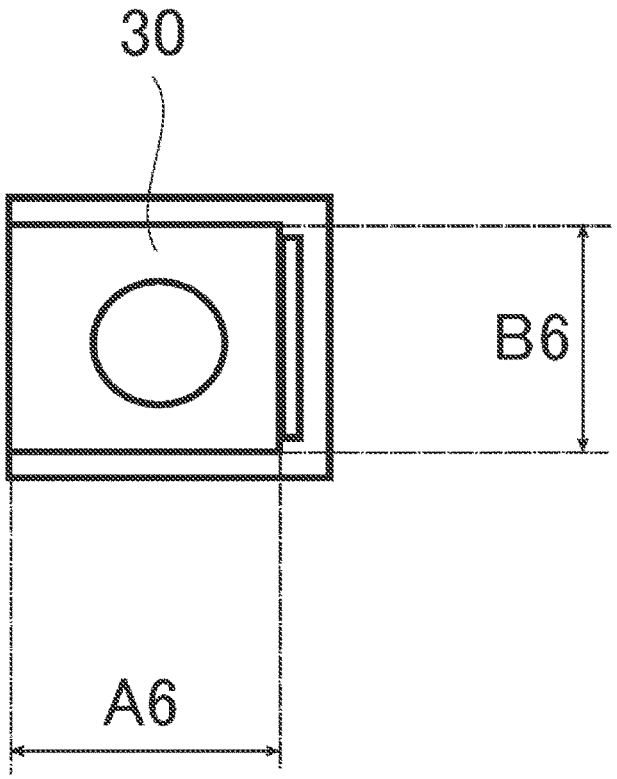
FIG. 8b

FIG. 9a
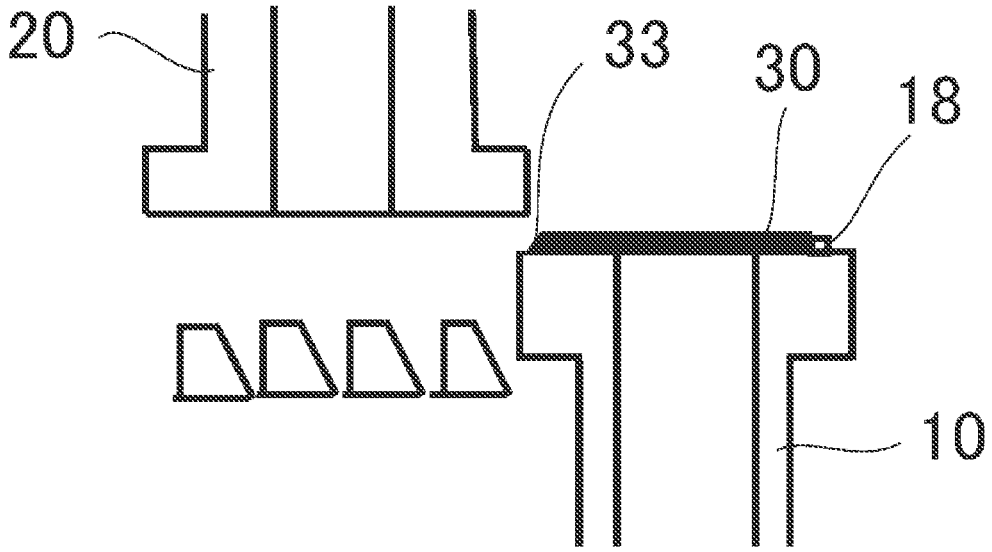
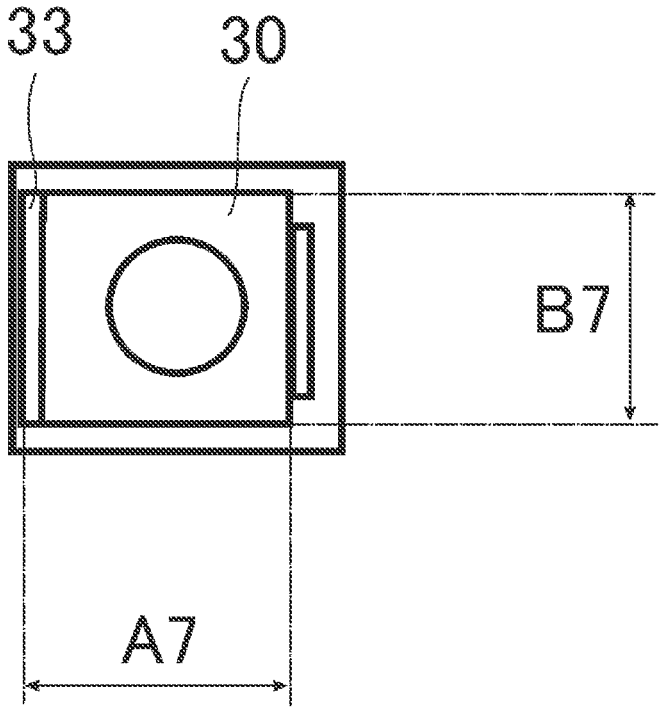
FIG. 9b

IMMERSION NOZZLE REPLACEMENT METHOD

TECHNICAL FIELD

The present invention relates to a method for replacing an immersion nozzle used for continuous steel casting.

BACKGROUND ART

In continuous steel casting, in order to discharge molten steel from a tundish into a mold, an immersion nozzle is used. The immersion nozzle is used while being joined to an upper refractory such as an upper nozzle, a sliding nozzle plate, or a lower nozzle, wherein among others the immersion nozzle is worn out by the molten steel and so forth, so that the method is known with which only the immersion nozzle is replaced during continuous casting.

In this replacement method, a used (old) immersion nozzle is replaced by pushing it out with a new immersion nozzle, so that the replacement can be done under the state that the immersion nozzle is immersed in a mold during continuous casting. With regard to the method for replacing the immersion nozzle during continuous casting, in order to minimize a leakage of the molten steel during replacement, the method is disclosed, for example, in Patent Document 1, wherein the replacement is carried out by sliding both the new and used immersion nozzles while being pressed upward to the upper refractory such as the upper nozzle, the sliding nozzle plate, or the lower nozzle.

In the replacement method of Patent Document 1, as depicted in FIGS. 10*a*-10*c* the flange portion 53 of the used immersion nozzle 52 (or still in use) is biased upward with the keyboard row 51 arranged in both sides thereof so as to be kept under the state of being pressed to the joint interface 54 of the upper nozzle 56; therefore, when the immersion nozzle 52 is replaced, the new immersion nozzle 52*a* is pushed toward a lateral direction with the pusher 58 that is connected to the cylinder 57 so as to replace the used immersion nozzle 52. At this time, the new immersion nozzle 52*a* is caused to slide while being pressed to the joint interface 54 of the upper nozzle 56, so that the immersion nozzle can be instantly replaced without causing leakage of the molten steel even during continuous casting.

However, in this replacement method, the upper nozzle and the immersion nozzle are pressure-joined between the refractory joint planes; therefore, a space can be formed occasionally between the joint planes due to the local abrasion during replacement work as well as the thermal expansion during use thereof or the variance of the plane accuracy at the time of production thereof. If the space is formed, there are risks of quality deterioration of the steel due to suction of an air through this space, and of leakage of the molten steel from the space.

On the other hand, in the case that the replacement method like this is not carried out, in general the immersion nozzle and the upper nozzle are joined via a shaped joint sealer so as to ensure the sufficient sealability. The shaped joint sealer is a refractory in the form of a flexible sheet having a cutout portion with the size as same as or a slightly larger than a nozzle hole of the immersion nozzle to be used, wherein this sealer is deformed upon pressing the immersion nozzle to the upper nozzle so that it can fill the space (Patent Documents 2 to 6). Some of the shaped joint sealer have flexibility in a wide temperature range from normal temperature to hot.

However, in the replacement method of Patent Document 1, the new immersion nozzle was caused to slide under the state that it was pressed to the upper nozzle; and thus, even the shaped joint sealer was arranged on the upper plane of the new immersion nozzle, this shaped joint sealer was scraped off or taken out by the upper nozzle, so that the shaped joint sealer could not be used.

Hence, the method for replacing the immersion nozzle in which the shaped joint sealer can be used is disclosed in Patent Document 7. In the replacement method of Patent Document 7, the new immersion nozzle is moved to below the upper nozzle with keeping a certain space with the upper nozzle's lower plane, so that the shaped joint sealer arranged on the upper plane of the new immersion nozzle can be kept in the state of being originally arranged on the immersion nozzle's upper plane without contacting to the upper nozzle during the immersion nozzle is moving.

However, with the replacement method of Patent Document 7, a space is formed between the new immersion nozzle and the upper nozzle during replacement, so that there is a problem that the molten steel drops on the upper plane of the new immersion nozzle thereby becoming foreign matters of the joint interface, resulting in decrease of the sealability. Meanwhile, during replacement, the flow of the molten steel is stopped by a stopper or the like, but the molten steel remaining in the nozzle hole drops.

CITATION LIST

Patent Documents

Patent Document 1: Registered Utility Model No. 3009112
Patent Document 2: Japanese Examined Patent Publication No. H60-15592
Patent Document 3: Japanese Patent No. 2977883
Patent Document 4: Japanese Patent Laid-Open Publication No. 2001-286995
Patent Document 5: Japanese Patent Laid-Open Publication No. 2009-227538
Patent Document 6: Japanese Patent Laid-Open Publication No. H07-330448
Patent Document 7: International Patent Laid-Open Publication No. 2002/094476

SUMMARY OF THE INVENTION

Problem to be Solved by the Invention

The problem to be solved by the present invention is to ensure high sealability in a method for replacing an immersion nozzle, wherein a used immersion nozzle is pushed out by a new immersion nozzle, whereby enabling a use of a shaped joint sealer in a joint interface while minimizing a leakage of molten steel during replacement.

Means for Solving the Problem

Inventors of the present invention found that when a concave portion is formed on an upper plane of a new immersion nozzle so as to include a nozzle hole (inner hole) and a shaped joint sealer is mounted in this concave portion, the shaped joint sealer is not slipped or scraped off so that it can be pressure-joined in a joint interface even if the upper plane of the new immersion nozzle is caused to slide while being pressed to a lower plane of an upper refractory. In addition, the inventors found that when a projection is formed on an upper plane of a new immersion nozzle with which a shaped joint sealer is locked, the shaped joint sealer is not slipped or scraped off so that it can be pressure-joined similarly to the above-mentioned.

Namely, according to the present invention, the methods for replacing the immersion nozzle described in following (1) to (6) are provided.

(1) A method for replacing an immersion nozzle, wherein a new immersion nozzle is supported by pressing members arranged in parallel in both sides of a lower plane of a flange portion and is caused to slide while being pressed to a lower plane of an upper refractory so as to push out a used immersion nozzle in a lateral direction thereby pressure-joining to the upper refractory, wherein a concave portion is formed on an upper plane of the new immersion nozzle so as to include a nozzle hole thereof, and a shaped joint sealer is mounted in this concave portion.

(2) A method for replacing an immersion nozzle, wherein a new immersion nozzle is supported by pressing members arranged in parallel in both sides of a lower plane of a flange portion and is caused to slide while being pressed to a lower plane of an upper refractory so as to push out a used immersion nozzle in a lateral direction thereby pressure-joining to the upper refractory, wherein a projection is formed on an upper plane of the new immersion nozzle in a position opposite to an insertion side of the new immersion nozzle, and a shaped joint sealer having a thickness more than a height of the projection is arranged so as to be locked with the said projection.

(3) The method for replacing the immersion nozzle according to (1), wherein the concave portion formed on the upper plane of the new immersion nozzle is open to a side plane in an insertion side of the new immersion nozzle.

(4) The method for replacing the immersion nozzle according to any one of (1) to (3), wherein the upper refractory has an inclined plane in its lower portion of an insertion side of the new immersion nozzle.

(5) The method for replacing the immersion nozzle according to any one of (1) to (4), wherein the shaped joint sealer has an inclined plane in an insertion side of the new immersion nozzle.

(6) The method for replacing the immersion nozzle according to any one of (1) to (5), wherein the shaped joint sealer has an expanding property.

Meanwhile, the shaped joint sealer described in the present invention is a flexible refractory in a plate-like shape having a cutout portion, the shape of which is equal to or somewhat larger than the nozzle hole of the immersion nozzle, namely the shape corresponding to the nozzle hole of the immersion nozzle, wherein the shaped joint sealer can fill a space with being deformed when the immersion nozzle is joined to the upper refractory.

Advantageous Effects of Invention

According to the method for replacing the immersion nozzle of the present invention, even if the upper plane of a new immersion nozzle is caused to slide while being pressed to the lower plane of the upper refractory, the shaped joint sealer is not slipped or scraped off. Therefore, this enables the shaped joint sealer to be used in the upper plane (joint plane) of the new immersion nozzle. In addition, because the upper plane of the new immersion nozzle provided with the shaped joint sealer is caused to slide while being pressed to the lower plane of the upper refractory, high sealability can be ensured even during replacement, so that a leakage of the molten steel during replacement can be minimized.

This is an explanatory drawing illustrating an image of the method for replacing the immersion nozzle according to the first embodiment of the present invention.

FIG. 1*b*

The same as above.

FIG. 1*c*

The same as above.

FIG. 1*d*

The same as above.

FIG. 2*a*

This is a vertical cross section view of the upper nozzle used in the first embodiment of the present invention.

FIG. 2*b*

This is a bottom view of the upper nozzle used in the first embodiment of the present invention.

FIG. 3*a*

This is a bottom view of the immersion nozzle used in the first embodiment of the present invention.

FIG. 3*b*

This is a top view of the immersion nozzle used in the first embodiment of the present invention.

FIG. 4

This is a plane view of the immersion nozzle used in the first embodiment of the present invention.

FIG. 5*a*

This is a vertical cross section view of the immersion nozzle used in the second embodiment of the present invention.

FIG. 5*b*

This is a top view of the immersion nozzle used in the second embodiment of the present invention.

FIG. 6

This is a plane view of the shaped joint sealer used in the second embodiment of the present invention.

FIG. 7*a*

This is a vertical cross section view of the upper nozzle used in the third embodiment of the present invention.

FIG. 7*b*

This is a bottom view of the upper nozzle used in the third embodiment of the present invention.

FIG. 8*a*

This is an explanatory drawing illustrating the fourth embodiment of the present invention.

FIG. 8*b*

This is a top view of the immersion nozzle used in the fourth embodiment of the present invention.

FIG. 9*a*

This is an explanatory drawing illustrating the fifth embodiment of the present invention.

FIG. 9*b*

This is a top view of the immersion nozzle used in the fifth embodiment of the present invention.

FIG. 10*a*

This is a perpendicular sectional view illustrating a conventional method for replacing an immersion nozzle disclosed in Patent Document 1.

FIG. 10*b*

Figure 10A:
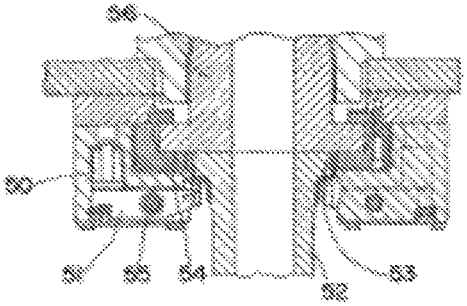
FIG. 10a (Prior Art)

This is a plan view of a part of FIG. 10*a*.

FIG. 10*c*

This is a perpendicular sectional view on a plane at a right angle to FIG. 10*a*.

DESCRIPTION OF THE EMBODIMENTS

First Embodiment

FIG. 1*a* to FIG. 1*d* are the explanatory drawings illustrating an image of the method for replacing the immersion nozzle according to the first embodiment of the present invention.

Figure 10B:
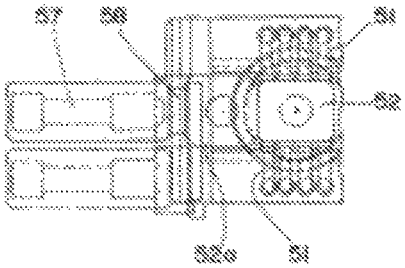
FIG. 10b (Prior Art)
Figure 10C:
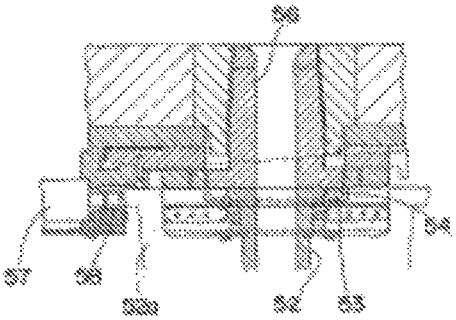
FIG. 10c (Prior Art)

In FIG. 1*a* to FIG. 1*d*, the new immersion nozzle 10 (hereunder, this is simply called "immersion nozzle 10") is supported by the keynote boards 4 served as the pressing members that are arranged in parallel in both sides of the flange's lower plane 16 and is caused to slide while being pressed to the upper nozzle's lower plane 21 as the upper refractory. The pressing mechanism by the keynote boards 4 and the sliding mechanism to slide the immersion nozzle 10 are the same as the mechanisms of Patent Document 1 mentioned before (FIG. 10). Specifically, four keynote boards 4 to press the both sides of the flange's lower plane 16 of the immersion nozzle 10 are arranged in one side thereof; and when the immersion nozzle 10 is moved by being pushed to an arrow direction with a driving mechanism not shown in the drawing, the immersion nozzle's upper plane 14 is caused to slide under the state of being pressed to the upper nozzle's lower plane 21 by the keynote boards 4. The pressing force at this time is 600 kgf. Meanwhile, in FIG. 1*a* to FIG. 1*d*, the used old (or still in use) immersion nozzle is omitted. However, when the immersion nozzle is joined to the upper nozzle for the first time, there is no old immersion nozzle so that this is in the same state as that of FIG. 1*a* to FIG. 1*d*; and thus, the present invention can also be applied even to this case.

Figure 2A:
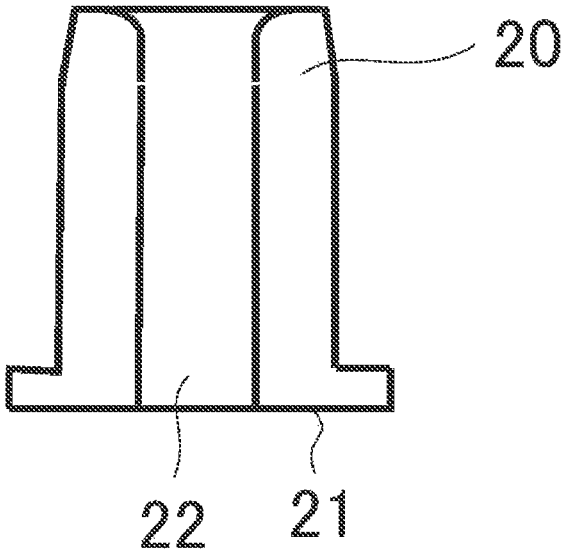
Figure 2B:
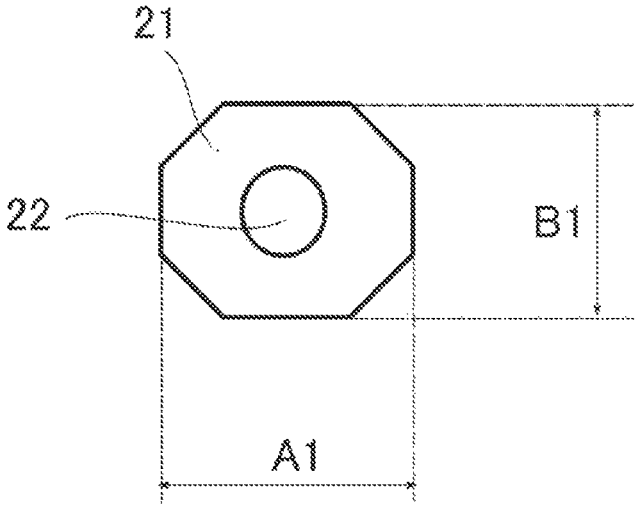

In the upper nozzle 20 used in this embodiment, as depicted in FIG. 2*a* (vertical cross section view) and FIG. 2*b* (bottom view), the main body is in the shape of almost a cylinder, and the flange portion in the lower portion thereof is in the shape of an octagonal pillar; and there is the nozzle hole 22 in the central portion thereof. The size A1 of the upper nozzle's lower plane 21 is 240 mm, the size B1 of the same is 220 mm, and the diameter of the nozzle hole in the upper nozzle's lower plane 21 is 77 mm.

Figure 3A:
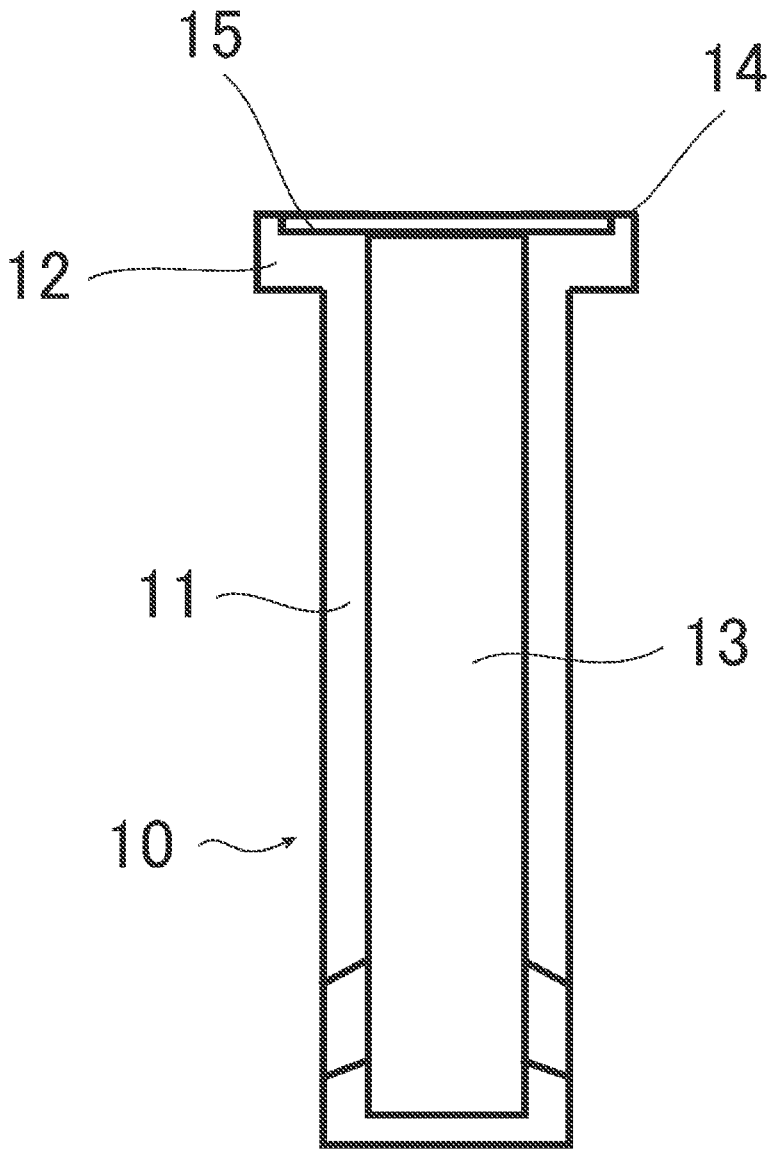
Figure 3B:
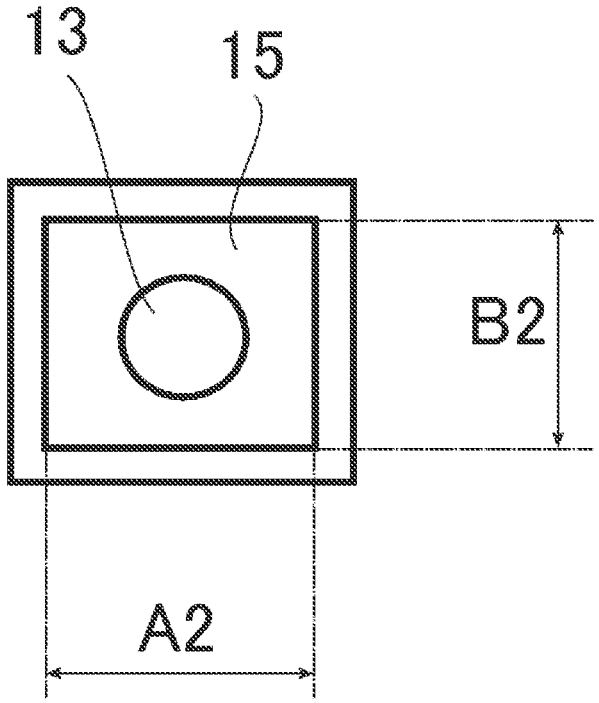

In the immersion nozzle 10 used in this embodiment, as depicted in FIG. 3*a* (vertical cross section view) and FIG. 3*b* (top view), the main body 11 is in the shape of a cylinder, and the flange portion 12 in the upper portion thereof is in the shape of a tetragonal pillar; and there is the nozzle hole 13 in the central portion thereof. The immersion nozzle's upper plane 14 is in a shape of a square with one side of 190 mm, and the diameter of the nozzle hole in the upper plane 14 is 80 mm. The immersion nozzle's upper plane 14 has the concave portion 15 arranged so as to include the nozzle hole 13, wherein it has the length A2 of 170 mm, the width B2 of 150 mm, and the depth of 3 mm.

Figure 4:
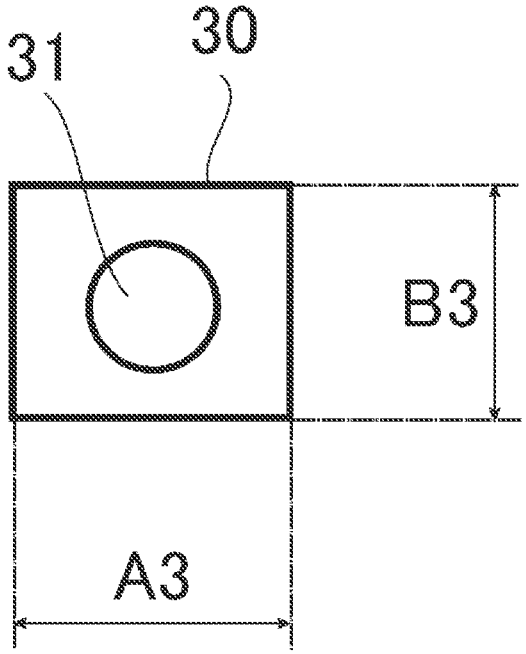

In concave portion 15 in the immersion nozzle's upper plane is mounted the shaped joint sealer 30 having a rectangular shape in the plane view with the circular cutout portion 31 (inner hole), as depicted in FIG. 4. The shaped joint sealer 30 has the length A3 of 165 mm, the width B3 of 140 mm, the cutout diameter (inner hole diameter) of 90 mm, and the thickness of 3.5 mm.

The shaped joint sealer 30 was produced with the same method as those disclosed in Patent Document 5. Specifically, the shaped joint sealer 30 was obtained by adding 25% by mass of acryl emulsion (bonding material) and 1% by mass of texanol (plasticizer) as outer percentages into the raw material powder blend of main raw materials including 50% by mass of sintered alumina and 20% by mass of fused mullite with auxiliary materials including 10% by mass of clay, 10% by mass of frit, and 1% by mass of flake graphite, followed by kneading the mixture thus obtained with a table-top mixer, press-molding it into a sheet form, and then drying it at about 80° C. Besides, as the shaped joint sealer 30, a generally used joint sealer to seal between the immersion nozzle and the upper nozzle may be used; for example, the joint sealers disclosed in Patent Documents 2 to 6 may be used.

Next, the method for replacing the immersion nozzle according to this embodiment will be specifically explained.

Figure 1A:
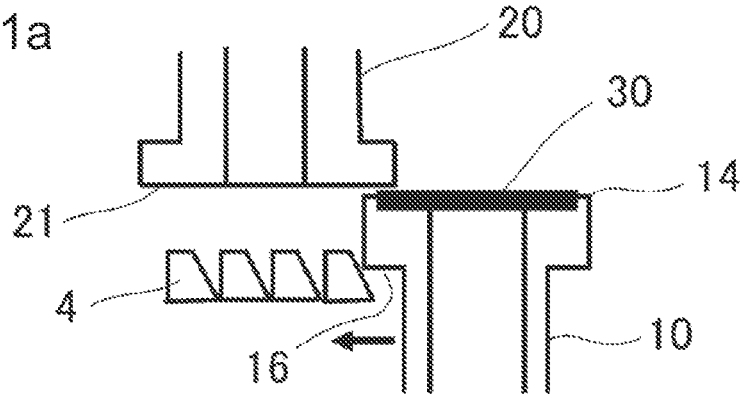
FIG. 1*a*
Figure 1B:
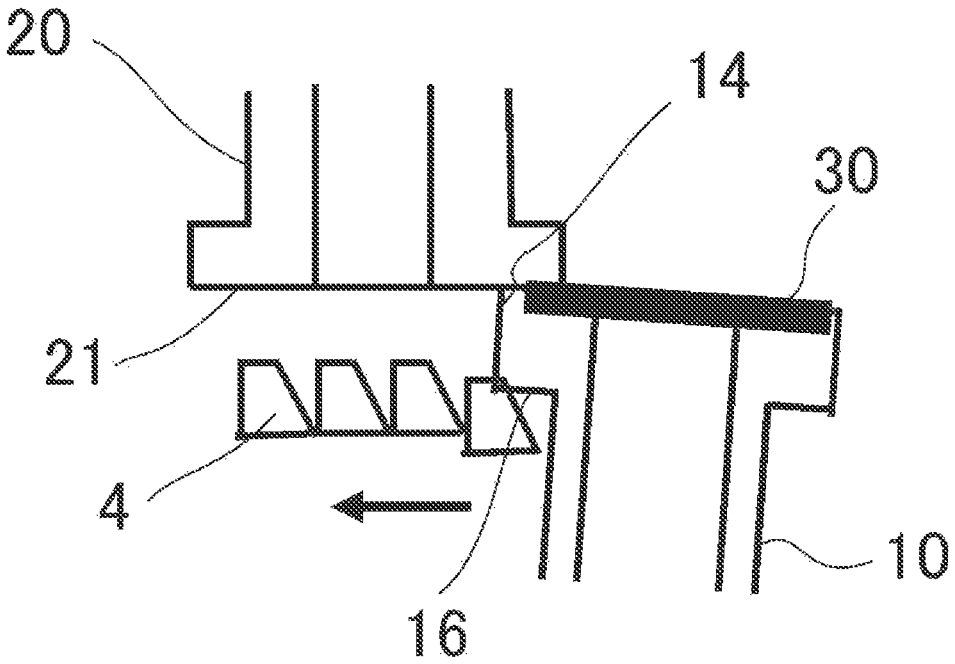
Figure 1C:
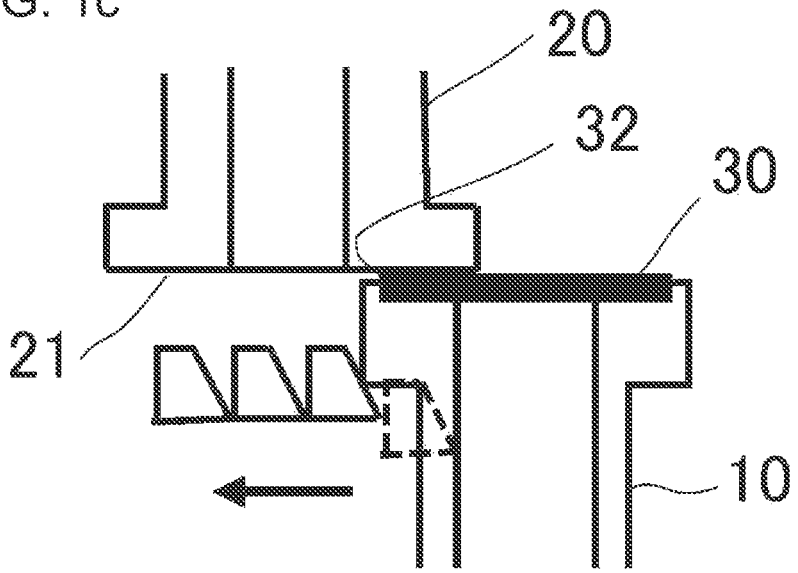
Figure 1D:
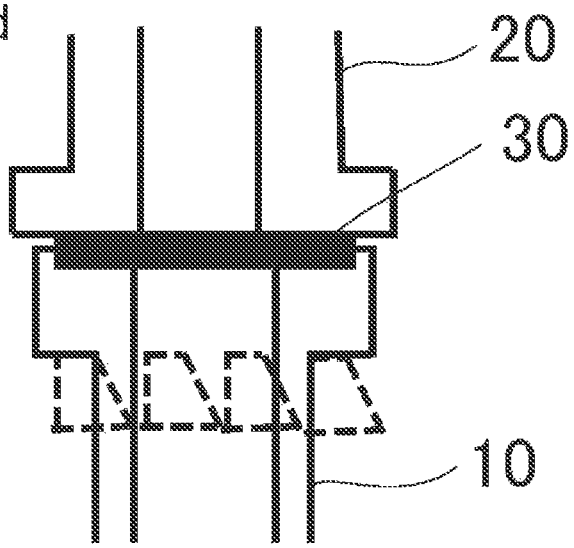

In FIG. 1*a*, as the immersion nozzle 10 is moved to left, first the flange's lower plane 16 of the immersion nozzle rides on the keynote boards 4 so that the immersion nozzle's upper plane 14 comes to contact to the upper nozzle's lower plane 21 thereby leading to the state of FIG. 1*b*. As the immersion nozzle further moves to left, the insertion side edge portion 32 of the shaped joint sealer 30 contacts to the upper nozzle's lower plane 21 so as to be sandwiched therein, and thus, the shaped joint sealer 30 contacts with the upper nozzle's lower plane 21 with sliding thereby leading to the state of FIG. 1*c*. At this time, because the shaped joint sealer 30 is not slipped out due to the side plane of the concave portion 15, the upper nozzle 20 can ride on the shaped joint sealer 30. The shaped joint sealer 30 moves along the upper nozzle's lower plane 21 while being pressed so as to be inserted between the upper nozzle 20 and the immersion nozzle 10 thereby leading to the state of FIG. 1*d*. At this time, the shaped joint sealer 30 was shrunk by about 0.3 mm.

As can be seen above, according to the method for replacing the immersion nozzle of this embodiment, even if the immersion nozzle's upper plane 14 is caused to slide while being pressed to the upper nozzle's lower plane 21, the shaped joint sealer 30 is not slipped or scraped off. Accordingly, it becomes possible to use the shaped joint sealer 30; and moreover, the shaped joint sealer 30 is compressed in the joint interface between the upper nozzle 20 and the immersion nozzle 10, so that formation of the space between the upper nozzle 20 and the immersion nozzle 10 can be avoided. In addition, because the concave portion 15 on the immersion nozzle's upper plane includes the nozzle hole 13, the shaped joint sealer 30 can move while being contacted with the upper nozzle 20 even around the nozzle hole 13. Therefore, even if the molten steel drops from the upper nozzle 20 during replacement of the immersion nozzle, it drops onto the shaped joint sealer 30; therefore, the molten steel is pushed into the shaped joint sealer 30, resulting in a smooth upper plane of the shaped joint sealer 30, so that formation of the space can be avoided. Consequently, high sealability can be ensured even during replacement, so that leakage of the molten steel during replacement can be minimized.

In addition, in this embodiment, as described above, because at first the shaped joint sealer 30 comes to contact to the upper nozzle's lower plane 21, the shaped joint sealer 30 can be surely sandwiched between the upper nozzle's lower plane 21 and the immersion nozzle's upper plane 14. Namely, when the thickness of the shaped joint sealer 30 is more than the depth of the concave portion 15 as in the case of this embodiment, it is preferable that the shaped joint sealer 30 is arranged in the position where the insertion side edge portion 32 can come to contact to the upper nozzle's lower plane 21 at first upon inserting the immersion nozzle.

However, on the contrary to this embodiment, even when at first the shaped joint sealer does not come to contact to the upper nozzle's lower plane 21 but does to the side plane thereof, because the shaped joint sealer 30 is soft and readily cut off, the insertion side edge portion (corner) is crushed or scraped off a bit, so that it can be sandwiched.

On the other hand, in the case that the thickness of the shaped joint sealer is equal to or less than the depth of the concave portion, the insertion side edge portion of the shaped joint sealer can be set at any position. In this case, the shaped joint sealer does not contact to the upper nozzle's lower plane during replacement of the immersion nozzle, but during replacement of the immersion nozzle, because as described above the immersion nozzle's upper plane 14 is caused to slide while being pressed to the upper nozzle's lower plane 21, the sealability in a level not causing a problem in the actual use can be ensured. In addition, even if the molten steel drops from the upper nozzle 20 during replacement of the immersion nozzle, because it drops onto the shaped joint sealer in the concave portion, the molten steel is pushed into the shaped joint sealer as described before, resulting in a smooth upper plane of the shaped joint sealer, so that formation of the space can be avoided, and also the leakage of the molten steel during replacement can be minimized.

Therefore, especially in the case that the thickness of the shaped joint sealer is equal to or less than the depth of the concave portion, it is preferable to use the shaped joint sealer which is expandable. Because the immersion nozzle is pre-heated in an air before replacement, by using the expandable shaped joint sealer which expands by this pre-heating (heating) or oxidation during pre-heating (heating), the thickness of the shaped joint sealer increases during replacement, so that the sealability is enhanced. Besides, use of the shaped joint sealer which is expandable is preferable also from the view point of enhancement of the sealability after replacement; and in addition, it is also effective in the case that the thickness of the shaped joint sealer is more than the depth of the concave portion.

As one embodiment of the shaped joint sealer which is expandable, the shaped joint sealer including expandable refractory particles may be cited. Illustrative example of the expandable refractory particles includes expandable graphite particles, expandable vermiculite particles, expandable obsidian particles, expandable pitchstone particles, expandable perlite particles, expandable clay particles, and expandable shale stone particles, wherein these may be used at least singly or as a mixture of two or more of them. In the shaped joint sealer including these expandable refractory particles, the sealability thereof is enhanced by expansion due to pre-heating of the expandable refractory particles before replacement or due to heating during the use thereof after replacement.

As other embodiment of the shaped joint sealer which is expandable, the shaped joint sealer including metals with low melting points such as Al, Mg, Cu, and Zn may be cited. In the shaped joint sealer including these metals with low melting points, the sealability thereof is enhanced by volume expansion of the metals with low melting points due to pre-heating before the replacement or oxidation caused by heating during the use after the replacement.

Second Embodiment

Figure 5A:
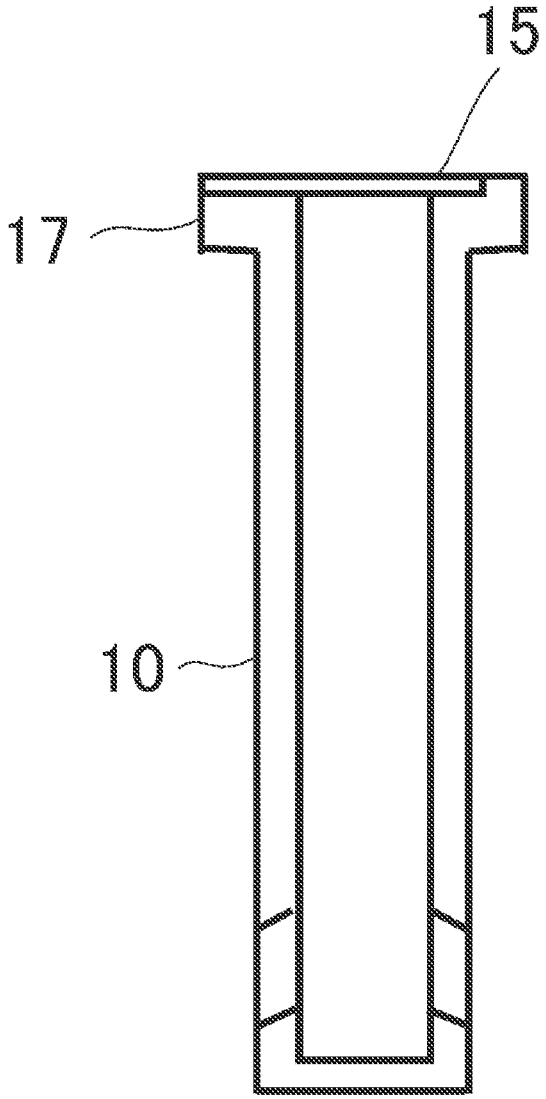
Figure 5B:
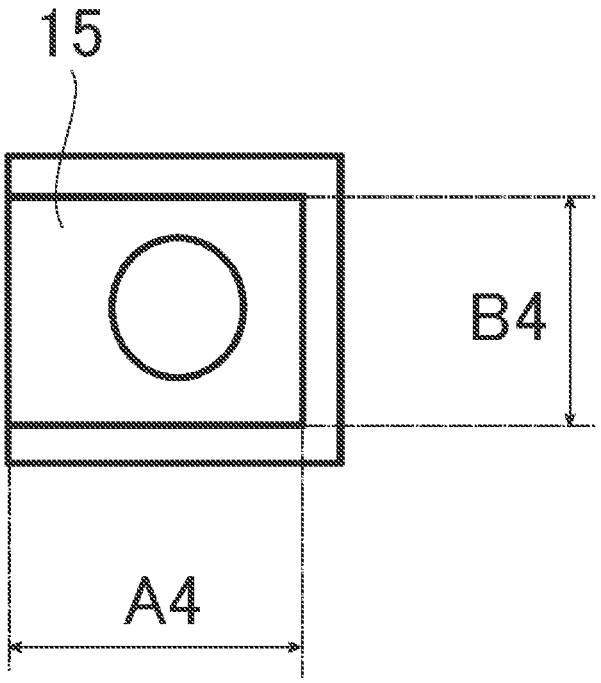
Figure 6:
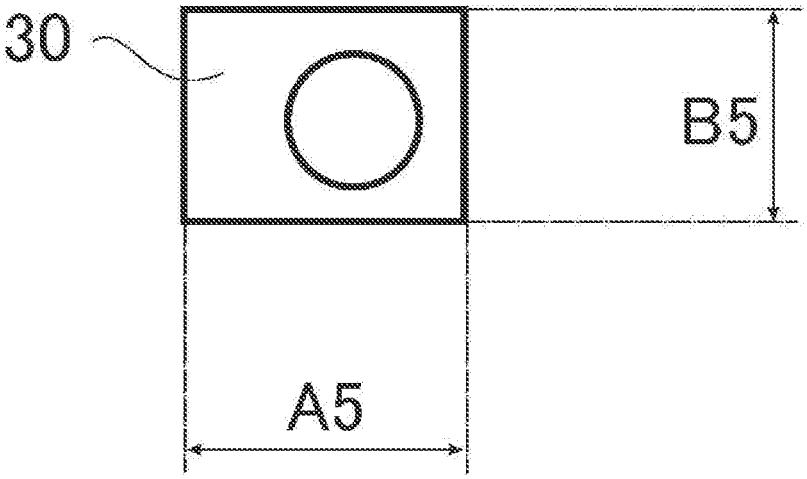

FIG. 5*a* is the vertical cross section view of the immersion nozzle used in the second embodiment of the present invention, and FIG. 5*b* is the top view thereof. In this embodiment, in the immersion nozzle in the first embodiment depicted in FIG. 3*a* and FIG. 3*b*, the concave portion 15 of the upper plane thereof is formed so as to open to the immersion nozzle's insertion side plane 17. Specifically, in the concave portion 15 in this embodiment, the length A4 is 165 mm, the width B4 is 140 mm, and the depth is 3 mm. Further, in the shaped joint sealer 30 mounted in the concave portion 15, as depicted in FIG. 6, the length A5 is 160 mm, the width B5 is 130 mm, and the thickness is 3.5 mm, wherein the size thereof is made such that it can be arranged until the immersion nozzle's insertion side plane 17.

This embodiment is also carried out in a similar manner to that of the first embodiment depicted in FIG. 1*a* to FIG. 1*d*. Namely, when the immersion nozzle 10 is moved to the lower side of the upper nozzle 20 by the driving mechanism, the immersion nozzle 10 is caused to slide while the flange's lower plane 16 is pressed to the upper nozzle's lower plane 21 by the keynote boards 4, so that the shaped joint sealer 30 can be sandwiched between the upper nozzle 20 and the immersion nozzle 10. Namely, in this embodiment, because three side planes of the shaped joint sealer 30 can be prevented from slipping due to three side planes of the concave portion 15 formed on the immersion nozzle's upper plane 14, the shaped joint sealer 30 can be pressure-joined to the joint interface without being slipped or scraped off.

Further, in this embodiment, because the shaped joint sealer 30 is arranged until the immersion nozzle's insertion side plane 17, even if the molten steel is somewhat dropped from the nozzle hole of the upper nozzle during replacement of the immersion nozzle, this can be surely pushed into the shaped joint sealer, so that formation of the space in the joint portion can be avoided. Accordingly, high sealability can be ensured so that leakage of the molten steel during replacement can be minimized as well.

Third Embodiment

FIG. 7*a* is the vertical cross section view of the upper nozzle used in the third embodiment of the present invention, and FIG. 7*b* is the bottom view thereof. In this embodiment, in the upper nozzle of the first embodiment depicted in FIG. 2*a* and FIG. 2*b*, the inclined plane 23 with R 30 mm is made in the lower edge portion thereof in the insertion side of the immersion nozzle. By making the inclined plane 23 like this, not only the slipping of the shaped joint sealer 30 during replacement of the immersion nozzle can be suppressed more surely, but also the smooth joint interface not having irregularity can be formed.

In the inclined plane that is made in the lower edge portion of the upper nozzle in the insertion side of the immersion nozzle, the shape of the vertical cross section view thereof may be linear or curved. The inclination angle of the inclined plane is preferably in the range of 10 to 70 degrees as the angle formed between the inclined plane and the extended plane of the upper nozzle's lower plane. When the shape of the vertical cross section view thereof is curved, R may be made, for example, in the range of 5 to 50 mm.

Fourth Embodiment

FIG. 8*a* is the explanatory figure illustrating the fourth embodiment of the present invention, and FIG. 8*b* is the top view of the immersion nozzle used in FIG. 8*a*. In this embodiment, instead of the concave portion formed in the immersion nozzle of the first embodiment depicted in FIG. 3*a* and FIG. 3*b*, the projection 18 is formed. Namely, the projection 18 whose height is less than the thickness of the shaped joint sealer 30 is formed on the immersion nozzle's upper plane 14 in the position opposite to the insertion side of the immersion nozzle. Specifically, the projection 18 is formed by adhering using an adhesive the iron plate having the height of 1 mm, the width of 3 mm, and the length of 120 mm to the immersion nozzle's upper plane 14.

On the other hand, in FIG. 8*b* the shaped joint sealer 30 has the length A6 of 170 mm, the width B6 of 140 mm, the cutout portion diameter (inner hole diameter) of 90 mm, and the thickness of 3.5 mm. Namely, in this embodiment, the projection 18 is formed on the immersion nozzle's upper plane 14 in the position opposite to the insertion side of the immersion nozzle 10, and the shaped joint sealer 30 whose thickness is more than the height of the projection 18 is arranged so as to be locked with the projection 18.

This embodiment is also carried out in a similar manner to that of the first embodiment depicted in FIG. 1*a* to FIG. 1*d*. Namely, when the immersion nozzle 10 is moved to the lower side of the upper nozzle 20 by the driving mechanism, the immersion nozzle 10 is caused to slide while the flange's lower plane 16 is pressed to the upper nozzle's lower plane 21 by the keynote boards 4, so that the shaped joint sealer 30 can be sandwiched between the upper nozzle 20 and the immersion nozzle 10. Namely, in this embodiment, because the shaped joint sealer 30 can be prevented from slipping by being locked with the projection 18, the shaped joint sealer 30 can be pressure-joined to the joint interface without being slipped or scraped off. In addition, because the height of the projection 18 is less than the thickness of the shaped joint sealer 30, the projection 18 does not become an obstacle in sliding of the immersion nozzle during its replacement.

Here, in this embodiment, in order to fully express the sealability due to the shaped joint sealer 30, it is preferable that the projection 18 is flexible. Meanwhile, because the projection 18 of this embodiment is formed of an iron plate, this is flexible.

Fifth Embodiment

FIG. 9*a* is the explanatory figure illustrating the fifth embodiment of the present invention, and FIG. 9*b* is the top view of the immersion nozzle used in FIG. 9*a*. In this embodiment, the shaped joint sealer 30 is made to be locked with the projection 18 in a similar manner to that of the fourth embodiment; and in addition, the inclined plane 33 is made in the insertion side of the shaped joint sealer 30. The shape of the vertical cross section view of the inclined plane 33 may be linear or curved. The inclination angle of the inclined plane is preferably in the range of 10 to 70 degrees as the angle formed between the inclined plane and the extended plane of the upper plane of the shaped joint sealer. When the shape of the vertical cross section view of the inclined plane is curved, R may be made, for example, in the range of 5 to 50 mm. Meanwhile, in this embodiment, the outer size of the shaped joint sealer 30 is as follows. Namely, the length A7 is 165 mm, the width B7 is 140 mm, the cutout portion diameter (inner hole diameter) is 90 mm, and the thickness is 3.5 mm.

This embodiment is also carried out in a similar manner to that of the first embodiment depicted in FIG. 1*a* to FIG. 1*d*. Namely, when the immersion nozzle 10 is moved to the lower side of the upper nozzle 20 by the driving mechanism, the immersion nozzle 10 is caused to slide while the flange's lower plane 16 is pressed to the upper nozzle's lower plane 21 by the keynote boards 4, so that the shaped joint sealer 30 can be sandwiched between the upper nozzle 20 and the immersion nozzle 10. On top of this, because the shaped joint sealer 30 has the inclined plane 33, the shaped joint sealer 30 can be sandwiched between the upper nozzle 20 and the immersion nozzle 10 more surely.

Meanwhile, in the first to fifth embodiments described above, the upper refractory joined to the immersion nozzle 10 was the upper nozzle 20. However, in the case that the upper refractory is other than the upper nozzle, for example, in the case of a sliding nozzle plate or a lower portion nozzle, it is a matter of course that the method for replacing the immersion nozzle of the present invention can also be used similarly.

The pressing and sliding mechanisms of the immersion nozzle are not limited to those of the previously described embodiments. In short, the mechanisms suffice only if they are as follows. Namely, when the new immersion nozzle is supported by the pressing members arranged in parallel in both sides of the flange's lower plane and is caused to slide while being pressed to the lower plane of the upper refractory, the immersion nozzle after use is pushed out in a horizontal direction so that the new immersion nozzle is pressure-joined to the upper refractory.

EXAMPLES

The results of replacement experiments of the immersion nozzle under various conditions are summarized in Table 1.

TABLE 1

| | | Example 1 | Example 2 | Example 3 | Example 4 | Example 5 | Example 6 | Example 7 | Example 8 | Example 9 | Comparative Example 1 |
|---|---|---|---|---|---|---|---|---|---|---|---|
| Pressing force of immersion nozzle (kgf) | | 600 | 600 | 600 | 600 | 400 | 800 | 600 | 600 | 600 | 600 |
| Material of shaped joint sealer | | KJC-A | KJC-A | KJC-A | KJC-A | KJC-A | KJC-A | KJC-B | KJC-C | KJC-D | KJC-A |
| Depth of concave portion (mm) | | 1 | 2 | 3 | 3 | 2 | 2 | 2 | 2 | 3 | 0 |
| Thickness of shaped joint sealer (mm) | Before replacement | 3.5 | 3.5 | 3.5 | 5 | 3 | 3 | 3 | 3 | 2 | 3.5 |
| | After replacement | 3.2 | 3.2 | 3.2 | 4.5 | 2.8 | 2.5 | 2.6 | 2.8 | 3 | 3.2 |
| State of shaped joint sealer after detachment | | GOOD | GOOD | GOOD | GOOD | GOOD | GOOD | GOOD | GOOD | GOOD | NOT GOOD |

In Table 1, Examples 1 to 9 are Examples of the present invention, wherein in the method for replacing the immersion nozzle as depicted in FIG. 1*a* to FIG. 1*d*, the upper nozzle depicted in FIG. 2*a* and FIG. 2*b* was used, but the depth of the concave portion of the immersion nozzle depicted in FIG. 3*a* and FIG. 3*b* was changed, and the shaped joint sealer depicted in FIG. 4 was changed in its thickness, its material of construction, or its flexibility. On the other hand, in Comparative Example 1 the shaped joint sealer was simply arranged on the immersion nozzle not having the concave portion. The experiments were carried out at room temperature except for Example 9 in which the immersion nozzle heated to 1000° C. was used.

Thickness of the shaped joint sealer was measured before and after the replacement. In the case of after the replacement, the measurement was carried out as follows. Namely, the immersion nozzle was moved to the position where the central axis of the nozzle hole of the upper nozzle matched the central axis of the immersion nozzle; and in this position, only the thickness of the shaped joint sealer at each of the center parts of 8 side planes in the lower part of the upper nozzle was measured, and then the average value of these measured values was calculated.

With regard to the surface state of the shaped joint sealer, after the immersion nozzle is detached, the state of the shaped joint sealer was visually observed, whereby the sealer without a void was assessed as GOOD, and the sealer with a void was assessed as NOT GOOD.

In Examples 1 to 3, the immersion nozzles with different thicknesses of the concave portion were used, wherein in all of them the shaped joint sealer was shrunk by about 10% while being uniformly filled between the immersion nozzle and the upper nozzle. There was no space or void on the surface after being detached so that they were joined well.

In Example 4, the shaped joint sealer having the thickness of 5 mm, which is thicker than other Examples, was used; a slight irregularity could be seen on the surface thereof after being detached, but it was in a level not causing a practical problem.

Example 5 is the case in which the pressing force of the immersion nozzle was 400 kgf, and Example 6 is the case in which the pressing force of the immersion nozzle was 800 kgf. In both cases, the shaped joint sealer could be filled without problems.

The material of the shaped joint sealer used in Examples 1 to 6 is the one as described in the first embodiment (KJC-A); namely it is obtained by adding 25% by mass of acryl emulsion (bonding material) and 1% by mass of texanol (plasticizer) as outer percentage into the raw material powder blend of main raw materials including 50% by mass of sintered alumina and 20% by mass of fused mullite with auxiliary materials including 10% by mass of clay, 10% by mass of frit, and 1% by mass of flake graphite.

In Example 7, amount of the binder was increased by 5% by mass relative to KJC-A so as to increase the flexibility (KJC-B). With this, the shaped joint sealer could be filled without problems.

In Example 8, amount of the binder was decreased by 5% by mass relative to KJC-A so as to increase the hardness (KJC-C). With this, the shaped joint sealer could be filled without problems.

In Example 9, in KJC-A, 2% by mass of the expandable graphite was used in place of 1% by mass of the flake graphite so as to impart the expanding property (KJC-D), and further, prior to the replacement the immersion nozzle was heated at 1000° C. With this, the shaped joint sealer could be filled without problems.

On the other hand, in Comparative Example 1, the concave portion was not formed in the immersion nozzle. With this, a space or a void was observed on the surface after the detachment, so this was not good.

Under the condition of Example 3, which corresponds to the first embodiment described before, the replacement work was carried out during actual continuous casting. With the methods of Patent Documents 1 and 7 described before, leakage of the molten steel was observed during replacement; on the contrary, with the method of the present invention, leakage of the molten steel was not observed during replacement.

EXPLANATION OF NUMERICAL SYMBOLS

10 Immersion nozzle
11 Main body
12 Flange portion
13 Nozzle hole (inner hole)
14 Immersion nozzle's upper plane
15 Concave portion
16 Flange's lower plane
17 Immersion nozzle's insertion side plane
18 Projection
20 Upper nozzle
21 Upper nozzle's lower plane
22 Nozzle hole
23 Inclined plane
30 Shaped joint sealer
31 Cutout portion (inner hole)
32 Insertion side edge portion
33 Inclined plane
4 Keynote boards (pressing members)

The invention claimed is:

1. A method for replacing an immersion nozzle, wherein a new immersion nozzle is supported by pressing members arranged in parallel in both sides of a lower plane of a flange portion and is caused to slide while being pressed to a lower plane of an upper refractory so as to push out a used immersion nozzle in a lateral direction thereby pressure-joining to the upper refractory, wherein a concave portion is formed on an upper plane of the new immersion nozzle so as to include a nozzle hole therein, and a shaped joint sealer is mounted in the concave portion.

2. A method for replacing an immersion nozzle, wherein a new immersion nozzle is supported by pressing members arranged in parallel in both sides of a lower plane of a flange portion and is caused to slide while being pressed to a lower plane of an upper refractory so as to push out a used immersion nozzle in a lateral direction thereby pressure-joining to the upper refractory, wherein a projection is formed on an upper plane of the new immersion nozzle in a position opposite to an insertion side of the new immersion nozzle, and a shaped joint sealer having a thickness more than a height of the projection is arranged so as to be locked with the projection.

3. The method for replacing the immersion nozzle according to claim 1, wherein the concave portion formed on the upper plane of the new immersion nozzle is open to a side plane in an insertion side of the new immersion nozzle.

4. The method for replacing the immersion nozzle according to claim 1, wherein the upper refractory has an inclined plane in its lower portion of an insertion side of the new immersion nozzle.

5. The method for replacing the immersion nozzle according to claim 1, wherein the shaped joint sealer has an inclined plane in an insertion side of the new immersion nozzle.

6. The method for replacing the immersion nozzle according to claim 1, wherein the shaped joint sealer includes expandable refractory particles selected from the group consisting of expandable graphite particles, expandable vermiculite particles, expandable obsidian particles, expandable pitchstone particles, expandable perlite particles, expandable clay particles, expandable shale stone particles, and combinations thereof.

7. The method for replacing the immersion nozzle according to claim 2, wherein the upper refractory has an inclined plane in its lower portion of an insertion side of the new immersion nozzle.

8. The method for replacing the immersion nozzle according to claim 3, wherein the upper refractory has an inclined plane in its lower portion of an insertion side of the new immersion nozzle.

9. The method for replacing the immersion nozzle according to claim 2, wherein the shaped joint sealer has an inclined plane in an insertion side of the new immersion nozzle.

10. The method for replacing the immersion nozzle according to claim 3, wherein the shaped joint sealer has an inclined plane in an insertion side of the new immersion nozzle.

11. The method for replacing the immersion nozzle according to claim 4, wherein the shaped joint sealer has an inclined plane in an insertion side of the new immersion nozzle.

12. The method for replacing the immersion nozzle according to claim 2, wherein the shaped joint sealer includes expandable refractory particles selected from the group consisting of expandable graphite particles, expandable vermiculite particles, expandable obsidian particles, expandable pitchstone particles, expandable perlite particles, expandable clay particles, expandable shale stone particles, and combinations thereof.

13. The method for replacing the immersion nozzle according to claim 3, wherein the shaped joint sealer includes expandable refractory particles selected from the group consisting of expandable graphite particles, expandable vermiculite particles, expandable obsidian particles, expandable pitchstone particles, expandable perlite particles, expandable clay particles, expandable shale stone particles, and combinations thereof.

14. The method for replacing the immersion nozzle according to claim 4, wherein the shaped joint sealer includes expandable refractory particles selected from the group consisting of expandable graphite particles, expandable vermiculite particles, expandable obsidian particles, expandable pitchstone particles, expandable perlite particles, expandable clay particles, expandable shale stone particles, and combinations thereof.

15. The method for replacing the immersion nozzle according to claim 5, wherein the shaped joint sealer includes expandable refractory particles selected from the group consisting of expandable graphite particles, expandable vermiculite particles, expandable obsidian particles, expandable pitchstone particles, expandable perlite particles, expandable clay particles, expandable shale stone particles, and combinations thereof.

* * * * *